United States Patent [19]

Tomko et al.

[11] Patent Number: 4,794,071

[45] Date of Patent: Dec. 27, 1988

[54] OPTICALLY BRIGHTENED PHOTOGRAPHIC SILVER HALIDE ELEMENT WITH A POLYOLEFIN PAPER COATED SUPPORT

[75] Inventors: Donna L. Tomko, Penfield; Kenneth Harbison, Rochester, both of N.Y.

[73] Assignee: Eastman Kodak Company, Rochester, N.Y.

[21] Appl. No.: 29,020

[22] Filed: Mar. 23, 1987

[51] Int. Cl.[4] ..... G03C 1/86

[52] U.S. Cl. ..... 430/538; 430/536; 430/517; 548/219

[58] Field of Search ..... 430/536, 538, 339, 517; 548/219

[56] References Cited

U.S. PATENT DOCUMENTS

| | | | |
|---|---|---|---|
| 3,260,715 | 7/1966 | Saunders | 260/240 |
| 3,366,575 | 1/1968 | Ono et al. | 252/301.2 |
| 3,411,908 | 11/1968 | Crawford et al. | 96/74 |
| 3,449,257 | 6/1969 | Tuite et al. | 252/301.2 |
| 3,501,298 | 3/1970 | Crawford | 96/85 |
| 3,615,551 | 10/1971 | Farnley | 430/538 |
| 3,973,963 | 8/1976 | Venor et al. | 430/538 |
| 4,188,220 | 2/1980 | Kasugat et al. | 430/538 |
| 4,282,355 | 8/1981 | Erckel et al. | 542/459 |
| 4,396,671 | 8/1983 | Wanka et al. | 430/536 |
| 4,447,524 | 5/1984 | Uno et al. | 430/536 |
| 4,558,002 | 11/1985 | Aotsuka et al. | 430/538 |
| 4,650,747 | 3/1987 | Uno et al. | 430/536 |

FOREIGN PATENT DOCUMENTS

| | | |
|---|---|---|
| 1026368 | 4/1966 | United Kingdom . |

*Primary Examiner*—Jack P. Brammer

*Attorney, Agent, or Firm*—William J. Davis

[57] ABSTRACT

An improved photographic support, especially useful for color prints, is comprised of a paper base material having thereon a polyolefin coating containing a white pigment and a mixture of optical brighteners, such mixture comprising certain fluorescent bis(benzoxazolyl)-stilbenes. The support exhibits improved brightness at low brightener concentration and unexpected resistance to brightener exudation.

7 Claims, No Drawings

OPTICALLY BRIGHTENED PHOTOGRAPHIC SILVER HALIDE ELEMENT WITH A POLYOLEFIN PAPER COATED SUPPORT

FIELD OF THE INVENTION

This invention relates to photographic supports and elements, and more particularly, to photographic supports and elements comprising a paper base material having thereon a polyolefin coating containing a white pigment and an optical brightener.

BACKGROUND OF THE INVENTION

A valuable class of photographic supports and elements comprises a paper base material having thereon a polyolefin coating containing a white pigment and an optical brightener. Such supports are particularly useful in the preparation of photographic elements such as color prints because they exhibit good brightness and excellent dimensional stability and are highly resistant to the action of aqueous acid and alkaline photographic processing solutions. The polyolefin coating provides a very smooth surface which is desirable when thin layers, such as silver halide emulsion layers, are to be coated thereover, U.S. Pat. No. 3,411,908 describes such a support which has achieved widespread commercial acceptance.

The purpose of the optical brightener is to make the white areas of the support appear even brighter. The optical brightener fluoresces upon irradiation with UV (ultraviolet) light, emitting visible light, usually bluish in hue, thus enhancing the brightness of the support. Optical brighteners for use in photographic print materials must absorb UV light, especially in the region from 360 to 420 nm, and reemit such light so as to enhance the brightness of the print, and have the desired brightening power. The optical brightener must also be stable to the temperatures, as high as 310°-330° C., used in incorporating it into the polyolefin and in extruding the polyolefin onto the paper base material.

Moreover, the optical brightener must be nonmigrating so that it remains in the polyolefin coating and does not exude as a surface film on the polyolefin. Such exudation not only can give rise to a nonuniform brightness of the reflection surface of the support, but also readily transfers to any other surface contacted with it. For example, brightener transferred nonuniformly to the back side of the adjacent layer of support when wound in roll form can adversely affect subsequent coating and finishing operations and, in consequence, the quality and performance of the final element.

U.S. Pat. No. 3,501,298 describes a photographic element having a support comprising a paper base having thereon a polyolefin coating which contains titanium dioxide and bis(alkylbenzoxazolyl)thiophenes.

U.S. Pat. No. 3,449,257 relates to compositions comprising hydrophobic polymers and nonmigrating optical brighteners and to paper supports coated with such compositions. The nonmigrating optical brighteners are 2,5-bis(benzoxazolyl)thiophenes.

U.S. Pat. No. 3,260,715 discloses fluorescent bis(benzoxazolyl)stilbenes, such as 4,4'-bis(benzoxazol-2-yl)stilbene, which are useful as fluorescent brightening agents for textile fibers, papers, resins and photographic color print materials.

However, these and other prior art brighteners do not exhibit the combination of absorption/emission characteristics and brightening power, heat stability, and resistance to brightener exudation to the levels desired for photographic supports and elements. Thus, what has been desired is a photographic element comprising an optically brightened support, such support having improved resistance to brightener exudation and wherein the brightener exhibits excellent absorption/emission characteristics, brightening power and heat stability.

SUMMARY OF THE INVENTION

We have discovered that a particular mixture of optical brighteners when incorporated into a pigmented polyolefin layer of a photographic support unexpectedly minimizes exudation of the brightener at the polyolefin surface. We have further discovered that this mixture also provides the excellent absorption/emission characteristics, brightening power and heat stabiliy that is needed to meet the critical requirements of the photographic field.

More particularly, in accordance with this invention, there is provided a photographic support comprising a paper base material having thereon a polyolefin coating containing a white pigment and a mixture of optical brighteners, such mixture comprising certain fluorescent bis(benzoxazolyl)stilbenes as hereinafter described. The support exhibits unexpected resistance to brightener exudation at the polyolefin surface.

It is another advantageous feature of the invention that such support exhibits excellent brightness at very low brightener concentration.

Yet another advantageous feature of this invention is that the aforesaid optical brightener mixture is stable at the temperatures, as high as 310°-330° C., used in incorporating brighteners into polyolefin and in extruding the polyolefin onto the paper base material.

In accordance with another embodiment of this invention, a photographic element comprises the above-described support and at least one silver halide emulsion layer. Such element can be a color print material or a black-and-white print material.

Other advantages of the invention will become apparent upon reference to the following description of the preferred embodiments.

DESCRIPTION OF THE PREFERRED EMBODIMENTS

The invention is hereinafter described particularly with regard to preferred embodiments as an optically brightened photographic support and a photographic element comprising such support. In addition, the invention is useful in other applications wherein an optically brightened polyolefin coating resistant to brightener exudation is desired.

The photographic support of this invention comprises a paper base material having thereon a polyolefin coating containing a white pigment and a mixture of optical brighteners which are fluorescent bis(benzoxazolyl)stilbenes. Such mixture preferably comprises

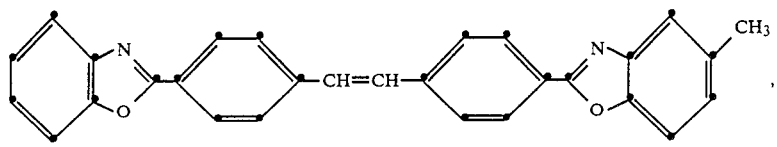

(A)

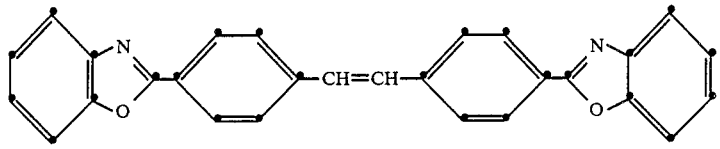

(B)

and

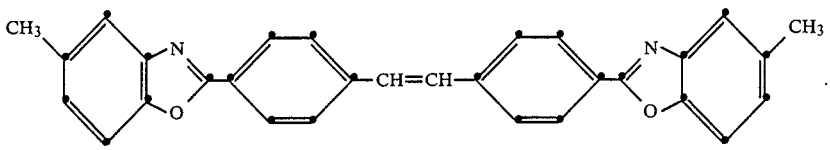

(C)

The photographic element in accordance with this invention comprises the above-described support and at least one silver halide emulsion layer. Such elements are particularly useful as reflection prints.

The mixture of optical brighteners useful herein comprises the above-noted bis(benzoxazolyl)stilbenes which are known optical brighteners. This mixture is also a known mixture for optical brightening use in polyolefin fibers, as described in U.S. Pat. No. 3,366,575; but its use in the polyolefin layer of a photographic element has not been disclosed nor suggested heretofore. To obtain such mixture, the individual compounds can be mixed according to conventional means or the mixture can be obtained as the product of the method of synthesis utilized. The individual compounds can be prepared by methods known in the art.

For example, compound A can be prepared by chlorination of a (benzoxazolyl)stilbenecarboxylic acid and subsequent reaction with an aminophenol. Details of such a preparation can be found in U.S. Pat. No. 4,282,355, the disclosure of which is hereby incorporated by reference.

Compound B can be prepared by the method described in U.S. Pat. No. 3,260,715, the disclosure of which is hereby incorporated by reference. Briefly, such method, illustrated particularly in Example 1 therein, comprises chlorination of a 4,4'-stilbenedicarboxylic acid and subsequent reaction with o-aminophenol.

Compound C can be prepared as described in U.K. Patent Specification No. 1,026,368 the disclosure of which is hereby incorporated by reference. Such preparation comprises the step of reacting 1-amino-2-hydroxy-5-methylbenzene with 4,4'-stilbenedicarboxylic acid.

Alternatively, the mixture of (A), (B) and (C) can be conveniently obtained as a reaction product. For example, the mixture can be obtained by reaction 4,4'-stilbene dicarboxylic acid with 1-amino-2-hydroxy-5-methylbenzene and 1-amino-2-hydroxybenzene in various proportions. This method is further described in U.S. Pat. No. 3,366,575, the disclosure of which is hereby incorporated by reference.

The relative amounts of components (A), (B) and (C) required to be present in the mixture to achieve the intended effects can be widely varied, as desired. Preferred mixtures include by weight about 15–90% of component (A), about 5–70% of component (B), and about 5–70% of component (C), such percentages being based on the total weight of the mixture. Highly preferred mixtures include about 40–70% of component (A), about 10–35% of (B), and about 10–35% of (C). It is believed that the unexpected resistance to brightener exudation may be due at least partly to an unusual crystalline form of the mixture which is more soluble and/or more stable in the polyolefin than the individual components of the mixture.

The amount of the brightener mixture which is used in the present invention is an amount effective to brighten the reflective layer. Such amounts of the mixture can be from 0.001% to 0.25% by weight based on the total weight of the polyolefin coating, including the white pigment. Excellent brightening with no or minimal, but acceptable, exudation has resulted when the mixture is present in an amount of 0.01% to 0.10% in the polyolefin coating. As noted, the mixture is stable to the temperatures as high as 310°–330° C., used in incorporating brightener into polyolefin and in extruding the polyolefin onto the paper base material.

The polyolefin can be any coatable polyolefin material known in the photographic art. Representative of these materials are polyethylene, polypropylene, polystyrene, polybutylene, and copolymers thereof. Polyethylene of low, medium or high density is preferred. The polyolefin can be copolymerized with one or more copolymers including polyesters, such as polyethylene terephthalate, polysulfones, polyurethanes, polyvinyls, polycarbonates, cellulose esters, such as cellulose acetate and cellulose propionate, and polyacrylates. Specific examples of copolymerizable monomers include vinyl stearate, vinyl acetate, acrylic acid, methyl acrylate, ethyl acrylate, acrylamide, methacrylic acid, methyl methacrylate, ethyl methacrylate, methacrylamide, butadiene, isoprene, and vinyl chloride. Preferred polyolefins are film forming and adhesive to paper. Polyethylene having a density in the range of from about 0.910 g/cm$^3$ to about 0.980 g/cm$^3$ is particularly preferred.

The optical brightener mixture can be incorporated into the polyolefin by conventional methods. Preferred are methods whereby the brightener is uniformly dispersed within the polyolefin. Such methods include a melt extrusion process, a kneader extruder, a roll mill, a high shear mixer, or a twin-screw compounder.

The white pigment incorporated in the polyolefin layer can be titanium dioxide, zinc oxide, zinc sulfide, zirconium dioxide, white lead, lead sulfate, lead chloride, lead aluminate, lead phthalate, antimony trioxide, white bismuth, tin oxide, white manganese, white tungsten and combinations thereof. The pigment is used in any form that is conveniently dispersed within the polyolefin. The preferred pigment is titanium dioxide. The titanium dioxide preferably is anatase, rutile or combinations of these forms. Enhanced image resolution in a photographic element can be obtained by the addition of functional amounts of such highly white-light reflective pigments to the polyolefin layer. Preferably, the white pigment is used in the range from about 3 to 35%, more preferably 5 to 25% by weight based on the total weight of the polyolefin coating. Titanium dioxide at levels of 5 to 20% is particularly useful.

In addition to the brightener mixture and the white pigment, the polyolefin coating can contain, if desired, a variety of additives including antioxidants such as 4,4'-butylidene-bis(6-tert-butyl-meta-cresol), di-lauryl-3,3'-thiodipropionate, N-butylated-p-aminophenol, 2,6-di-tert-butyl-p-cresol, 2,6-di-tert-butyl-4-methylphenol, N,N-disalicylidene-1,2-diaminopropane, tetra(2,4-di-tert-butylphenyl)-4,4'-diphenyldiphenyldiphosphonite, octadecyl 3-(3',5'-di-tert-butyl-4'-hydroxyphenyl propionate), combinations of the above, and the like; heat stabilizers, such as higher aliphatic acid metal salts such as magnesium stearate, calcium stearate, zinc stearate, aluminum stearate, calcium palmitate, sodium palmitate, zirconium octylate, sodium laurate, and salts of benzoic acid such as sodium benzoate, calcium benzoate, magnesium benzoate and zinc benzoate; additional optical brighteners; antistatic agents; dispersing agents; coating aids; slip agents; lubricants; dyes; and the like, as is well known to those skilled in the art. Additionally, emulsion side resins can contain one or more pigments, such as the blue, violet or magenta pigments described in U.S. Pat. No. 3,501,298, or pigments such as barium sulfate, colloidal silica, calcium carbonate and the like.

The paper base material employed in accordance with the invention can be any paper base material which has heretofore been considered useful for a photographic support. The weight and thickness of the support can be varied depending on the intended use. A preferred weight range is from about 20 g/m$^2$ to about 500 g/m$^2$. Preferred thicknesses (those corresponding to commercial grade photographic paper) are from about 20 μm to about 500 μm. It is preferred to use a paper base material calendered to a smooth surface. The paper base material can be made from any suitable paper stock preferably comprising hard or softwood. Either bleached or unbleached pulp can be utilized as desired. The paper base material can also be prepared from partially esterified cellulose fibers or from a blend of wood cellulose and a suitable synthetic fiber such as a blend of wood cellulose and polyethylene fiber.

As is known to those skilled in the art, the paper base material can contain, if desired, agents to increase the strength of the paper such as wet strength resins, e.g., the amino-aldehyde or polyamide-epichlorohydrin resins, and dry strength agents, e.g., starches, including both ordinary starch and cationic starch, or polyacrylamide resins. In a preferred embodiment of this invention, the amino-aldehyde, polyamide-epichlorohydrin and polyacrylamide resins are used in combination as described in U.S. Pat. No. 3,592,731. Other conventional additives include water soluble gums, e.g., cellulose ethers such as carboxymethyl cellulose, sizing agents, e.g., a ketene dimer, sodium stearate which is precipitated onto the pulp fibers with a polyvalent metal salt such as alum, aluminum chloride or aluminum sulfate; fluorescing agents; antistatic agents; fillers, including clays or pigments such as titanium dioxide; dyes; etc.

The coating of the paper base material with the polyolefin preferably is by extrusion from a hot melt as is known in the art. The paper base material preferably is treated with corona discharge to obtain good adhesion before the polyolefin coating is extruded thereon, as described in U.S. Pat. No. 3,411,908. The invention can be practiced within a wide range of extrusion temperatures, e.g., 150°-350° C., and speeds, e.g., about 60 m/min. to 460 m/min., depending on the particular intended application of the support. For many applications, preferred extrusion temperatures are about 310°-330° C. As noted, it is an advantageous feature of this invention that the mixture of optical brighteners is stable to such temperatures. Under these conditions, the aforedescribed polyolefin coating, over which the silver halide emulsion is applied, is coated onto the paper base material in a coverage of about 1 to 100 g/m$^2$, at a uniform thickness ranging from about 1 to 100 μm. About the same coverage of clear polyethylene coating preferably is applied to the side of the paper base material opposite to the pigmented polyolefin coating. As such, the polyolefin coatings are particularly effective in preventing acid and alkaline photographic processing solutions from penetrating to the paper base.

As noted, photographic elements in accordance with this invention comprise the above-described optically brightened photographic support and at least one silver halide emulsion layer. Any of the known silver halide emulsion layers, such as those described in *Research Disclosure,* Vol. 176, December 1978, Item 17643 and *Research Disclosure,* Vol. 225, January 1983, Item 22534, the disclosures of which are hereby incorporated by reference in their entirety, are useful in preparing photographic elements in accordance with this invention. Generally, the photographic element is prepared by coating the support with one or more layers comprising a dispersion of silver halide crystals in an aqueous solution of gelatin, and optionally, one or more subbing layers, etc. The coating process is generally carried out on a continuously operating machine wherein a single layer or a plurality of layers are applied to the support. For multilayer elements, layers are generally coated simultaneously on the support as described in U.S. Pat. No. 2,761,791, and U.S. Pat. No. 3,508,947. Additional useful coating and drying procedures are described in *Research Disclosure,* Vol. 176, December 1978, Item 17643.

In a preferred embodiment of this invention, a conventional UV absorbing agent is disposed in the photographic element to enhance speed and improve image stability and/or sharpness.

In addition to being nonmigrating, optical brighteners for use in reflection prints must exhibit particular criticalities not required for conventional uses of such compounds. As noted, optical brighteners for use in reflection print supports must absorb UV light especially in the region from 360 to 420 nm and reemit such light so as to enhance the brightness of the print. The mixture of brighteners used in the practice of this invention exhibits absorption/emission characteristics as good as or better than other brighteners presently utilized in photographic print materials. Further, we have found that this mixture provides the desired brightening power at low brightener concentrations, which is commercially attractive from a cost saving standpoint. Further still, the disclosed brightener mixture has been found to be stable to the temperatures as high as 330° C., which are used in incorporating brighteners into polyolefin and in extruding the polyolefin onto the paper base material in commercial processes. Moreover, as is known to those skilled in the art, supports for use in reflection prints are generally prepared and stored in roll form, which has a tendency to aggravate the exudation problem. The unexpected resistance to brightener exudation of the support of this invention is advantageously exhibited when rolls of the coated support material are stored for prolonged periods of time, such as weeks or months, which is highly desirable. Closely related brighteners that are outside our invention are inoperative because they exude from the polyolefin coating. Thus, it is both unexpected and highly advantageous that our support is free of unacceptable brightener exudation.

EXAMPLES

The following examples further illustrate the invention.

EXAMPLE 1

The surface of a high quality paper base material having a thickness of 178 μm and a basis weight of 185 g/m$^2$ was coated with clear polyethylene in a thickness of 30 μm (29 g/m$^2$) and the opposite surface of the paper base material was coated with polyethylene, coating 12.5% by weight of titanium dioxide and the fluorescent brightener shown in Table 1, in a thickness of 28 μm (27 g/m$^2$). Rolls of the polyolefin coated support were stored for prolonged periods of time, such as several weeks or months, and thereafter examined by visual inspection under UV light and tested for exudation of brightener by rubbing the surface of the polyolefin coating with a white non-fluorescent glove and then observing the glove under the UV light.

The fluorescence of these samples was determined by spectrophotometric measurements using a Diano Matchscan TM spectrophotometer, with results being reported herein in terms of "Δb*" values. b* is a measure of the blueness/yellowness specified by the 1976 CIElab colorimetric measurement system. Δb* is a measure of movement along the b* axis determined as the absolute value of the difference of b* measured with and without the UV component of the light source present. A KODAK WRATTEN TM Filter No. 2A, available from Eastman Kodak Co., was used to exclude the UV component of the light source. These measurements were obtained in a mode which excluded the specular component of reflected light.

The results summarized in Table 1 indicate that the support of this invention, comprising a paper base material having thereon a polyolefin coating containing a white pigment and the mixture of optical brighteners (A), (B) and (C) described above, exhibits improved brightness and unexpected resistance to brightener exudation compared to a support containing brightener (B) alone and compared to a prior art support which has achieved widespread commercial importance. The support of this invention (Example 1) exhibited no exudation, even after storage for 6 months in roll form, whereas Comparative Examples 1 and 2 exhibited unacceptable exudation within 2 months and 1 month, respectively.

TABLE 1

| Sample No. | Fluorescent Brightener | Amt. Added Weight % | Fluorescence (Δb*) | Exudation |
|---|---|---|---|---|
| Ex. 1 | 60:24:16 mixture of (A):(B):(C) | 0.05 | 6.88 | None |
| Comp. Ex. 1 | (B) alone | 0.05 | 6.27 | Light |
| Comp. Ex. 2 | Uvitex-OB | 0.05 | 4.10 | Severe |

Uvitex-OB is the trade name for an optical brightener, commercially available from Ciba-Geigy, having the formula:

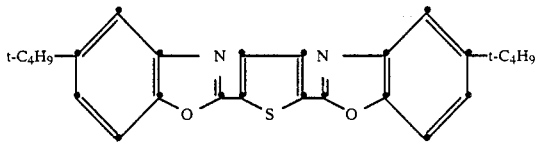

EXAMPLES 2–6

Example 1 was repeated except that the concentration of the brightener mixture was as indicated in Table 2 below. Samples were tested as described above. After 35 days storage in roll form, none of these examples exhibited exudation.

TABLE 2

| Example | Amount Added Weight % | Fluorescence (Δb*) |
|---|---|---|
| 2 | 0.01 | 3.65 |
| 3 | 0.03 | 5.34 |
| 4 | 0.05 | 6.62 |
| 5 | 0.07 | 7.29 |
| 6 | 0.10 | 7.76 |

EXAMPLES 7–9

Example 1 was repeated except that the concentration of the brightener mixture was as indicated in Table 3 below and the fluorescence was determined using a Spectrogard TM spectrophotometer, available from Pacific-Scientific Co. The differences between the measured fluorescence (Δb*) of Examples 7–9 and Examples 1–6 result partly from a lower UV energy content of the light source. Further, the measurements in Examples 7–9 were obtained in a mode which included the specular component of reflected light. (The relative fluorescence of Examples 8 and 9, however, was about the same as Examples 4 and 6, respectively.) Samples were tested as described above. After 4 months storage in roll form, none of these examples exhibited exudation.

TABLE 3

| Example | Amount Added Weight % | Fluorescence (Δb*) |
|---|---|---|
| 7 | 0.02 | 2.82 |
| 8 | 0.05 | 3.77 |
| 9 | 0.10 | 4.58 |

COMPARATIVE EXAMPLE 3

To achieve about the same brightening effect as in Examples 1 and 4 above, the brightener described in U.S. Pat. No. 3,449,257 had to be incorporated into the polyolefin in a substantially higher concentration, typically at a concentration of about 0.20 weight percent. Such support stored in roll form exhibited severe brightener exudation at the polyolefin surface.

The invention has been described in detail with particular reference to preferred embodiments thereof, but it will be understood that variations and modifications can be effected within the spirit and scope of the invention.

What is claimed is:

1. A photographic element comprising a support and at least one silver halide emulsion layer, said support comprising a paper base material having thereon at least one polyolefin coating containing at least one white pigment present in an amount of 3–35% by weight based on the total weight of said polyolefin coating, said polyolefin coating comprising a mixture of optical brighteners, said mixture consisting of 15–90% by weight based on the total weight of said mixture of (A)

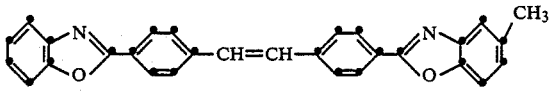

5–70% by weight based on the total weight of said mixture of (B)

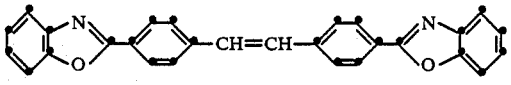

and

5–70% by weight based on the total weight of said mixture of (C)

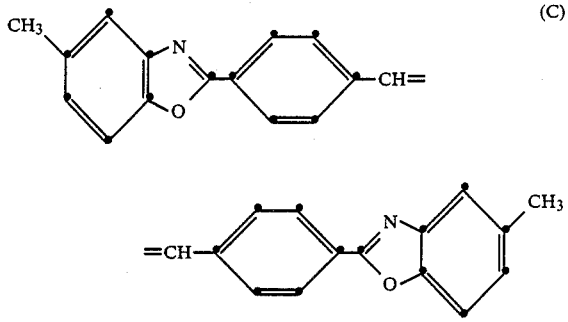

said mixture being present in an amount of 0.001 to 0.25 percent by weight based on the total weight of said polyolefin coating, and wherein said silver halide emulsion layer is on the same side of said paper base material as said polyolefin coating containing said mixture of optical brighteners.

2. The element of claim 1 wherein said white pigment is titanium dioxide.

3. The element of claim 1 wherein said polyolefin is polyethylene.

4. The element of claim 1 wherein said support further comprises a clear polyethylene coating on the side of said paper base material opposite to said pigmented polyolefin coating.

5. The element of claim 1 wherein said brightener mixture is present in an amount of 0.01 to 0.10% by weight based on the total weight of the polyolefin coating.

6. The element of claim 1 wherein said brightener mixture comprises by weight 40–70% of component (A), 10–35% of component (B), and 10–35% of component (C) based on the total weight of said mixture.

7. The element of claim 1 wherein said pigment is present in an amount of 5 to 25% by weight based on the total weight of the polyolefin layer.

* * * * *